US009464494B2

(12) United States Patent
Marica et al.

(10) Patent No.: US 9,464,494 B2
(45) Date of Patent: Oct. 11, 2016

(54) TRACK GUIDING SYSTEM

(71) Applicant: National Oilwell Varco, L.P., Houston, TX (US)

(72) Inventors: Adrian Marica, Cypress, TX (US); Ionescu Mihai, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 739 days.

(21) Appl. No.: 13/847,631

(22) Filed: Mar. 20, 2013

(65) Prior Publication Data

US 2013/0220703 A1 Aug. 29, 2013

Related U.S. Application Data

(63) Continuation of application No. 12/710,634, filed on Feb. 23, 2010, now Pat. No. 8,424,616.

(51) Int. Cl.

| | |
|---|---|
| ***E21B 19/20*** | (2006.01) |
| ***E21B 19/24*** | (2006.01) |
| ***B61B 15/00*** | (2006.01) |
| ***E21B 15/00*** | (2006.01) |

(52) U.S. Cl.

CPC ..... *E21B 19/24* (2013.01); *B61B 15/00* (2013.01); *E21B 15/00* (2013.01)

(58) Field of Classification Search

CPC .... A63H 18/00; A63H 18/02; Y10T 16/376; Y10T 16/373; Y10T 16/379; Y10T 24/44573; Y10T 29/53539; Y10T 29/53543; Y10T 137/6903; Y10T 403/66; Y10T 403/7043; Y10T 403/7045; Y10T 403/65; Y10T 403/655; B61B 13/00; B61B 13/02; B61B 13/04

USPC ..... D21/564, 565

See application file for complete search history.

(56) References Cited

U.S. PATENT DOCUMENTS

| | | | | |
|---|---|---|---|---|
| 2,843,326 A * | 7/1958 | Boy | E01B 11/28 | 238/219 |
| 2,928,356 A * | 3/1960 | Treadwell | B65G 49/045 | 104/89 |
| 2,998,196 A * | 8/1961 | Eenigenburg, Jr. | A63H 19/30 | 238/10 A |
| 3,693,542 A | 9/1972 | Moehlenpah | 100/231 | |

(Continued)

FOREIGN PATENT DOCUMENTS

| | | |
|---|---|---|
| CN | 2856116 Y | 1/2006 |
| CN | 200952103 Y | 9/2007 |

(Continued)

*Primary Examiner* — Michelle Lopez
*Assistant Examiner* — Chinyere Rushing-Tucker
(74) *Attorney, Agent, or Firm* — Amerson Law Firm, PLLC

(57) ABSTRACT

A track guiding system includes a first track segment having a first end and a second end, the first track segment including a first linear beam segment operatively coupled to a first linear plate segment. The track guiding system further includes and a second track segment having a first end and a second end, the second track segment including a second linear beam segment operatively coupled to a second linear plate segment, wherein the first end of the first track segment is adapted to be operatively coupled to the second end of the second track segment, a first end of the first linear beam segment proximate the first end of the first track segment being adapted to overlap a second end of the second linear plate segment proximate the second end of said second track segment when the second track segment is operatively coupled to the first track segment.

28 Claims, 6 Drawing Sheets

(56) References Cited

U.S. PATENT DOCUMENTS

| | | | | |
|---|---|---|---|---|
| 3,867,989 | A | 2/1975 | Hisey et al. | 173/147 |
| 3,915,244 | A | 10/1975 | Brown | 175/85 |
| 3,987,877 | A * | 10/1976 | Bulanchuk | H02G 5/04 104/108 |
| 3,994,350 | A | 11/1976 | Smith et al. | 175/85 |
| 4,212,372 | A | 7/1980 | Murphy et al. | 184/15.3 |
| 4,314,611 | A | 2/1982 | Willis | 173/197 |
| 4,337,992 | A | 7/1982 | Johnson | |
| 4,437,524 | A | 3/1984 | Boyadjieff et al. | 173/190 |
| 4,489,794 | A | 12/1984 | Boyadjieff | 175/85 |
| 4,589,503 | A | 5/1986 | Johnson et al. | 175/113 |
| 4,625,796 | A | 12/1986 | Boyadjieff | 166/77.52 |
| 4,629,014 | A | 12/1986 | Swisher et al. | 175/220 |
| 4,813,493 | A | 3/1989 | Shaw et al. | 173/164 |
| 4,858,700 | A | 8/1989 | Shafer | 173/185 |
| 4,875,529 | A | 10/1989 | Wetch et al. | |
| 5,038,871 | A | 8/1991 | Dinsdale | 175/52 |
| 5,251,709 | A | 10/1993 | Richardson | 175/220 |
| 5,381,867 | A * | 1/1995 | Berry | E21B 15/00 175/85 |
| 5,433,279 | A | 7/1995 | Tessari et al. | 173/213 |
| 5,755,296 | A | 5/1998 | Richardson et al. | |
| 5,794,721 | A | 8/1998 | Clonch et al. | 175/45 |
| 5,904,789 | A | 5/1999 | Durkos | 156/64 |
| 5,921,329 | A | 7/1999 | Armstrong | 175/57 |
| 6,024,181 | A | 2/2000 | Richardson et al. | |
| 6,814,164 | B2 | 11/2004 | Mills et al. | 175/52 |
| 6,951,082 | B2 | 10/2005 | Nelson et al. | |
| 7,320,374 | B2 | 1/2008 | Folk et al. | 175/220 |
| 7,779,904 | B2 | 8/2010 | Zhang | |
| 8,181,721 | B1 | 5/2012 | Keast | |
| 2003/0006043 | A1 | 1/2003 | Luca et al. | 166/379 |
| 2004/0136813 | A1 | 7/2004 | Pietras | 414/22.51 |
| 2005/0269072 | A1 | 12/2005 | Folk et al. | 166/90.1 |
| 2005/0274508 | A1 * | 12/2005 | Folk | E21B 19/02 166/77.52 |
| 2006/0118294 | A1 | 6/2006 | Haakenson | 166/77.52 |
| 2010/0006664 | A1 * | 1/2010 | Hein | E01B 11/42 238/149 |
| 2013/0019773 | A1 * | 1/2013 | Rosenwinkel | B65G 47/96 104/118 |
| 2013/0145723 | A1 * | 6/2013 | Mahoney | E21B 15/00 52/848 |
| 2014/0097027 | A1 * | 4/2014 | Marica | E21B 7/023 175/220 |

FOREIGN PATENT DOCUMENTS

| | | |
|---|---|---|
| CN | 200964552 Y | 10/2007 |
| GB | 21299 | 0/1913 |
| GB | 226946 | 11/1923 |

* cited by examiner

TRACK GUIDING SYSTEM

CROSS-REFERENCE TO RELATED APPLICATION

This is a continuation of co-pending application Ser. No. 12/710,634, filed Feb. 23, 2010.

BACKGROUND OF THE INVENTION

1. Field of the Invention

The present disclosure relates generally to track guiding systems for guiding travel of an object along a defined path, and more particularly to a track guiding system for guiding travel of an object along a vertical path.

2. Description of the Related Art

A top drive is an example of a device requiring guided travel along a defined path. In this case, the defined path is a vertical path. The top drive is used to rotate a drill string from the top of the drill string, typically while the drill string is in a borehole. The top drive includes at least one motor and a gear system. The motor is coupled to the gear system, and the gear system is connected to a short pipe, which is in turn attached to the top of the drill string. The top drive is suspended on a hook at the end of a traveling block. The traveling block itself is suspended by cables from the top of a derrick. The traveling block moves up and down the derrick by means of the cables, and the top drive moves with the traveling block. A track guiding system is used to guide the travel of the top drive in a vertical direction along the derrick. Typically, the track guiding system includes a wheeled carriage adapted to run on a pair of vertical tracks. The vertical tracks are anchored to the rig floor or bottom of the derrick and extend up the derrick. The top drive is coupled to the wheeled carriage for guided travel up and down the vertical tracks.

FIG. 1 is a perspective view of a prior-art track guiding system for guiding travel of a top drive along a vertical path. The vertical track guiding system includes a beam 1 having parallel sides 3, 5. Tracks 4, 6 are formed at the parallel sides 3, 5, respectively. The following discussion applies to both tracks 4, 6, but only track 4 will be specifically mentioned. Track 4 consists of plates 7, 9, which are welded to the side 3 of the beam 1. The plates 7, 9 are spaced apart to define a channel 15. Rollers 17, which are coupled to a carriage 21, travel in and along the channel 15. The rollers 17 and carriage 21 constitute a wheeled carriage. In use, the top drive (not shown) would be mounted on the carriage 21 for guided travel along the tracks 4, 6.

For the vertical track guiding system of FIG. 1, ideally, the plates 7, 9 should be parallel so that the channel 15 has a constant width along the length of the beam 1, the width being the gap between the plates 7, 9. However, because of distortion of the plates 7, 9, either during manufacturing of the plates or attachment of the plates to the beam 1, the plates 7, 9 will not be truly parallel. Non-parallelism would occur even if the plates 7, 9 were initially precisely positioned on the beam 1. Very often, the width at one or more points in the channel 15 will be smaller than the width of the rollers 17 so that the rollers 17 become periodically jammed in the channel 15. A pulling force applied to the top drive (not shown) coupled to the carriage 21 will dislodge the rollers 17 from the jammed position, but at a cost, i.e., the rollers 17 will deform the plates 7, 9. At these deformed locations in the channel 15, the rollers 17 will either wobble or slide (as opposed to roll) along the plates 7,9.

Typically, several lengths of beams are stringed together to form a sufficient length of track to guide the travel of the top drive up and down the derrick. Connections between the plates on adjacent beams are typically not smooth, particularly because it is difficult to make two beams and plate attachments that have the same dimensions and tolerances. Rollers tend to jump when they encounter these non-smooth connections.

Wobbling, sliding or jumping of the rollers will adversely affect the stability of the top drive as the top drive travels up and down the guiding system. Instability of the top drive may, in turn, affect the quality of the borehole being drilled by the drill string. Deformation of the track plates may also reduce longevity of the track guiding system.

While the top drive is coupled to a guided wheeled carriage and used to rotate a drill string, the axial axis of the top drive needs to be aligned with the vertical. In the current art, a screw-type fixed-adjustment mechanism is used initially to adjust the verticality of the top drive. Subsequent adjustments may take place at regular operating time intervals or when required. In the current art, operators have to periodically, or as required, physically measure the verticality of tracks at a given position along the tracks where the top drive is located and then adjust the verticality of the top drive based on this measurement. With this approach, verticality is adjusted for a given position of the top drive along the tracks. Since it is unknown how the tracks will deform while in operation or after a certain period, the verticality adjustment of the top drive is valid only for the given position of the top drive along the tracks. During drilling, the position of the top drive along the tracks will vary, and the top drive may not be truly vertical for a portion of its travel along the tracks. This can result in drilling of a poor-quality borehole, e.g., one having a non-uniform cross-section where a uniform cross-section is desired.

The present disclosure is directed to various methods and devices that may avoid, or at least reduce, the effects of one or more of the problems identified above.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Generally, the subject matter disclosed herein relates to a top drive track guiding system used for drilling boreholes. The track guiding system may also be adjusted during operation so as to maintain alignment of the top drive in a substantially vertical direction.

In one illustrative embodiment of the present subject matter, a track guiding system is disclosed that includes, among other things, a first track segment having a first end and a second end, the first track segment including a first linear beam segment that is operatively coupled to a first linear plate segment. Additionally, the disclosed track guiding system includes a second track segment having a first end and a second end, the second track segment also including a second linear beam segment that is operatively coupled to a second linear plate segment, wherein the first end of the first track segment is adapted to be operatively coupled to the second end of the second track segment. Furthermore, a first end of the first linear beam segment proximate the first end of the first track segment is adapted to overlap a second end of the second linear plate segment proximate the second end of the second track segment when the second end of said second track segment is operatively coupled to the first end of the first track segment.

In a further exemplary embodiment, a track guiding system that includes a plurality of track segments is disclosed, wherein each one of the plurality of track segments is adapted to be operatively coupled to another one of the plurality of track segments. Furthermore, each of the plurality of track segment includes, among other things, a linear plate segment having a first plate end and a second plate end, the first plate end having a generally V-shaped prong connection and the second plate end having a generally V-shaped receptor connection, wherein the V-shaped prong connection is adapted to operatively engage a corresponding V-shaped receptor connection of an adjacent linear plate segment when one of the plurality of track segments is operatively coupled to another one of the plurality of track segments. Additionally, each of the plurality of track segments also includes a linear beam segment operatively coupled to the linear plate segment, the linear beam segment having a first beam end and a second end. Moreover, the first beam end overhangs the first plate end along a length direction of the track segment and the second plate end overhangs the second beam end along the length direction of the track segment, wherein the second plate end is adapted to overlap the first beam end when one of the plurality of track segments is operatively coupled to another one of the plurality of track segments.

BRIEF DESCRIPTION OF THE DRAWINGS

The disclosure may be understood by reference to the following description taken in conjunction with the accompanying drawings, in which like reference numerals identify like elements, and in which.

Figure 1:
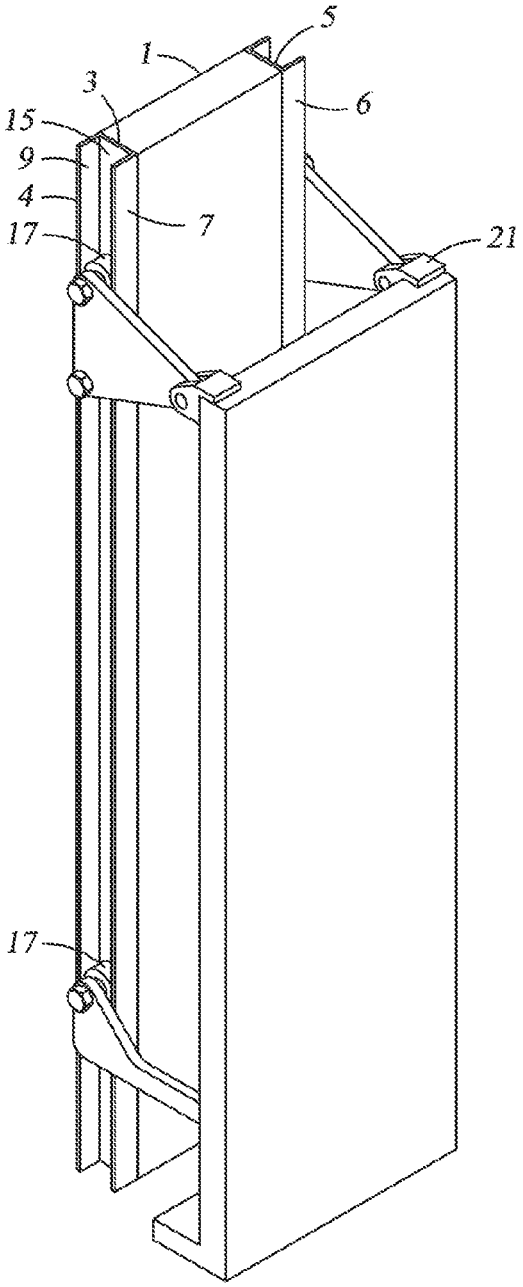
FIG. 1 (PRIOR ART)
FIG. 1 is a perspective view of a prior-art vertical track guiding system for a top drive.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2:
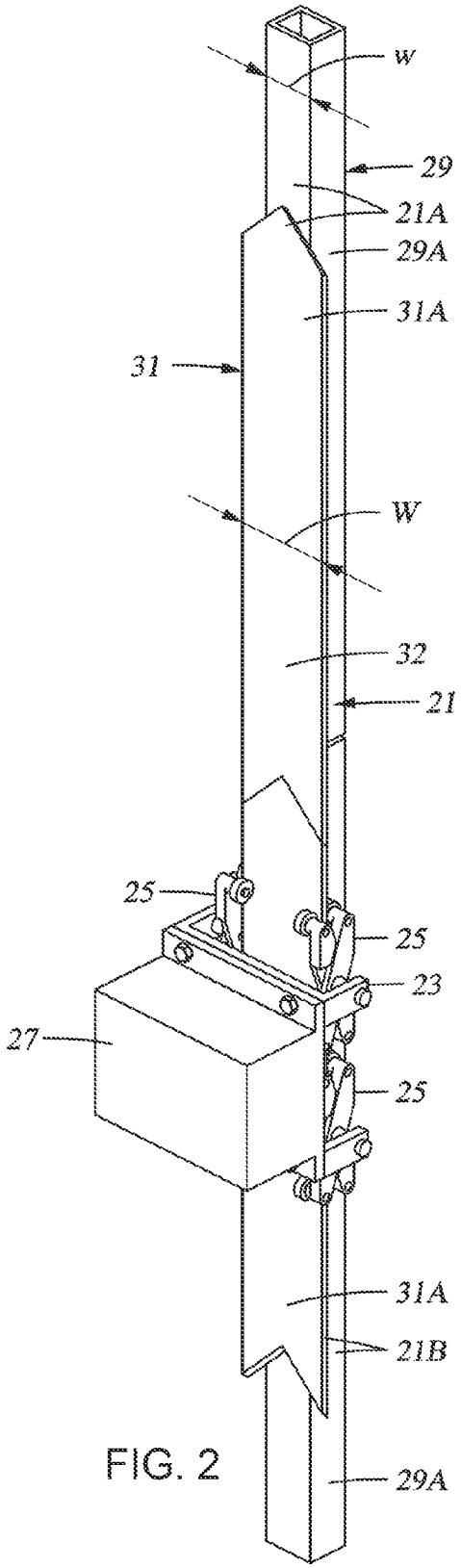
FIG. 2 is a perspective view of a top drive coupled to an illustrative track guiding system as disclosed herein.

FIG. 2 shows one illustrative embodiment of a track guiding system disclosed herein, including a track 21 and a carriage 23. The carriage 23 may be, for example, any structure or platform or frame to which an object needing travel along a specified path may be coupled. The carriage 23 and any object coupled to it may travel along the track 21 by means of compound edge rollers 25 operatively coupled to the carriage 23 and mounted on the track 21. In the embodiment shown in FIG. 2, the carriage 23 and compound edge rollers 25 constitute a wheeled carriage. In some embodiments, there can be at least a pair of compound edge rollers 25 at the opposite edges of the track 21. In the illustrative embodiment shown in FIG. 2, for example, there are two pairs of compound edge rollers 25, with a pair each at the opposite edges of the track 21. As shown in FIG. 2, one example of an object that may be coupled to the carriage is a top drive 27. In alternative uses of the track guiding system, other types of objects, e.g., robot or camera, may be coupled to the carriage 23. In FIG. 2, the various attachments to the top drive 27 are not shown, but these attachments are well known in the art.

As illustrated in FIG. 2, the track 21 is typically oriented in a vertical direction to guide travel of the carriage 23 and any object coupled to it along a substantially vertical path. In alternative uses of the track guiding system, the track 21 may be oriented in other directions, e.g., horizontal or inclined, for guided travel of the carriage 23 and any object coupled to it along a corresponding non-vertical path. In some embodiments, the track 21 may be made of, for example, a linear beam 29 and a linear plate 31. In yet other embodiments, the linear beam 29 may be made of one or more separate linear beam segments 29A. Similarly, the linear plate 31 may, in some embodiments, be made of one or more separate linear plate segments 31A. Typically, there are equal numbers of linear beam segments 29A and linear plate segments 31A, with one linear beam segment 29A for each linear plate segment 31A. In such embodiments, each linear plate segment 31A is operatively coupled to one of the linear beam segments 29A. A linear beam segment 29A operatively coupled to a linear plate segment 31A may be regarded as a track segment. Thus, the track 21 may also be considered as being made up of one or more track segments. In the embodiment illustrated in FIG. 2, there are two types of track segments, designated as 21A and 21B. The differences between track segment type 21A and track segment type 21B are in the positioning and length of the linear plate segment 31A relative to the attached linear beam segment 29A. In track segment type 21A, the lengths of the linear plate segment 31A and the attached linear beam segment 29A are approximately the same, the linear plate segment 31A overlaps the attached linear beam segment 29A, and an end portion 32 of the linear plate segment 31A overhangs the attached linear beam segment 29A. In track segment type 21B, the linear plate segment 31A is shorter than the attached linear beam segment 29A, the linear plate segment 31A overlaps the attached linear beam segment 29A, and there is no end portion of the linear plate segment 31A that overhangs the attached linear beam segment 29A. In some embodiments, the track segment type 21B is used at the bottom of the track 21, while the subsequent track segments in the track 21 are of type 21A. The linear beam segments 29A and the linear plate segments 31A could, in some illustrative embodiments, be made of metal material, alloy material, composite material, or a combination of metallic and composite materials. The linear plate segments 31A could be operatively coupled to the linear beam segments 29A by any number of methods well known those skilled in the art, such as, for example, by welding and the like.

Figure 3:
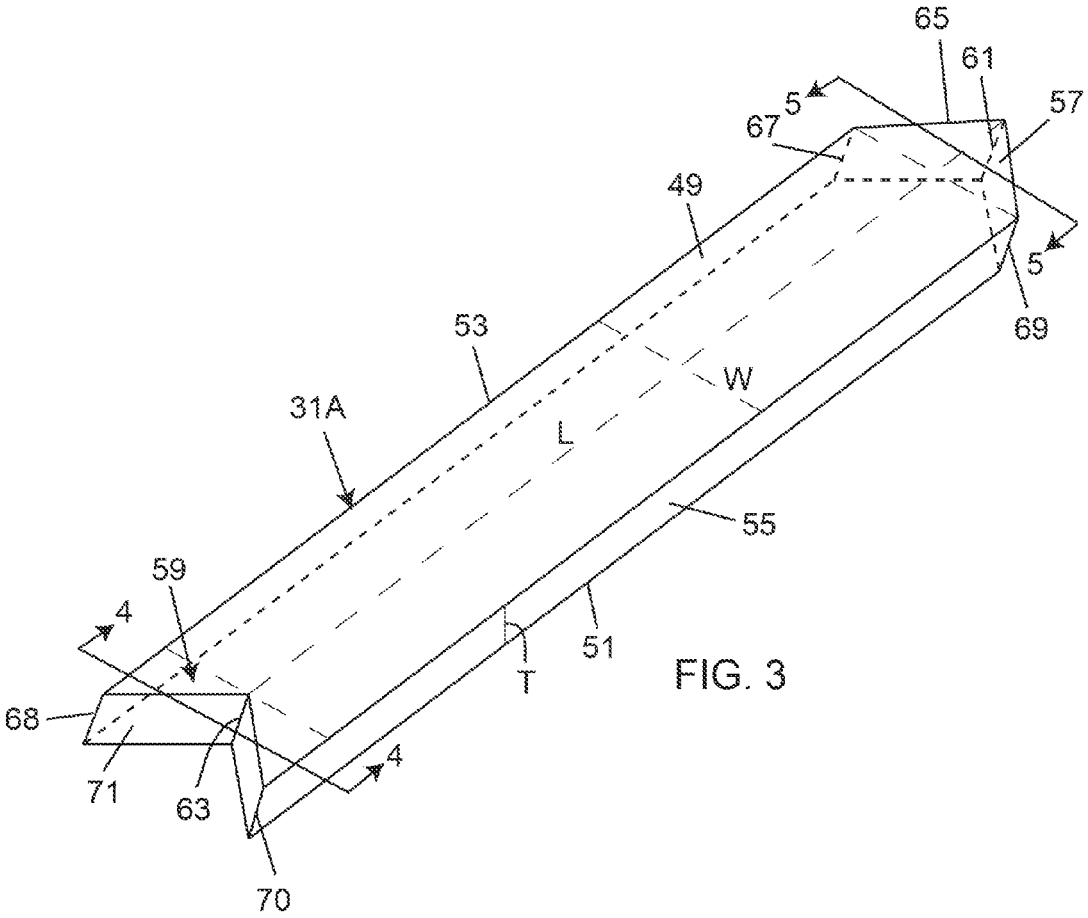
FIG. 3 is a perspective view of a linear plate segment of one illustrative embodiment of the track guiding system disclosed herein.

FIG. 3 is a perspective view of one illustrative embodiment of the linear plate segment 31A. As shown in FIG. 3, the linear plate segment 31A may have opposing front and back surfaces 49, 51, separated by a distance, such as for example a plate thickness T. The back surface 51 of linear plate segment 31A is operatively coupled to a corresponding linear beam segment (see 29A, 31A in FIG. 2). In FIG. 3, the linear plate segment 31A has opposing side edges 53, 55, separated by a distance, such as for example a plate width W. The linear plate segment 31A also has opposing ends 57, 59, separated by a distance, such as for example a plate length L. Depending on the specific application, the plate length L may be of any appropriate length, but in some embodiments is at least several feet long. The plate width W may be small compared to the plate length L, the plate thickness T may be small compared to the plate width W, and furthermore the plate thickness T may be very small compared to the plate length L. In some embodiments, the plate length L may be on the order of 30 feet and the plate thickness T may be on the order of 1 inch, but it should be appreciated by those skilled in the art that other dimensions may be used, and that these values are not intended to impose any limitations on the plate length and plate thickness. In subsequent discussion, the plate end 57 will be referred to as the prong end, while the plate end 59 will be referred to as the receptor end, and the reason for this naming convention will be apparent shortly. In certain embodiments, the prong end 57 may be outwardly tapered along the plate length L and the receptor end 59 may be inwardly tapered along the plate length L. Thus, the prong end 57 may be designed to plug into something, e.g., a receptor, while the receptor end 59 may be designed to receive something, e.g., a prong. For purposes of discussions related to the prong end 57, "outwardly-tapered" means that the apex 61 of the prong end is outboard of the linear plate segment 31A. Likewise, for purposes of discussions related to the receptor end 59, "inwardly-tapered" means that the apex 63 of the receptor end 59 is inboard of the linear plate segment 31A.

In certain illustrative embodiments, the prong end 57 may be externally V-shaped, whereas the receptor end 59 may be internally V-shaped. The apices 61, 63 of the prong end 57 and receptor end 59, respectively, could in some embodiments be sharp, or in other embodiments be rounded. In the illustrative embodiment shown in FIG. 3, the prong end 57 has an outer edge 65 that is contiguous with the opposing side edges 53, 55 of the linear plate segment 31A. The corners 67, 69 between the outer edge 65 and the opposing edges 53, 55 may in some cases be rounded to avoid stress concentration at those corners. Similarly, the receptor end 59 has an inner edge 71 that is contiguous with the opposing side edges 53, 55 of the linear plate segment 31A. The corners 68, 70 between the inner edge 71 and the opposing side edges 53, 55 may also be rounded to avoid stress concentration at those corners. In some embodiments, the outer edge 65 of the prong end 57 may be tapered along the plate thickness T. In certain other embodiments, the inner edge 71 of the receptor end 59 may be tapered along the plate thickness T.

Figure 4:
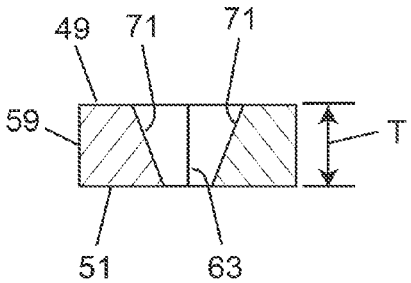
FIG. 4 is a cross-section of the linear plate segment of FIG. 3 along line 4-4.
Figure 5:
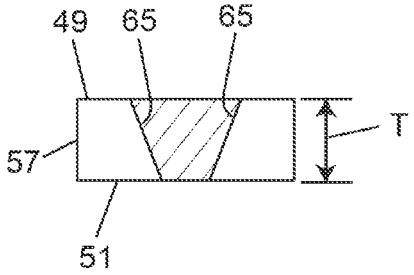
FIG. 5 is a cross-section of the linear plate segment of FIG. 3 along line 5-5.

FIG. 4 shows a cross-section of one illustrative embodiment of the linear plate segment 31A, where the section line is cut through the receptor end 59, along line 4-4. In embodiment shown in FIG. 4, the taper of the inner edge 71 of the receptor end 59 slopes inwardly from the front surface 49 to the back surface 51. FIG. 5 shows a similar cross-section at the opposite end of the linear plate segment 31A, where the section line is cut through the prong end 57, along line 5-5. In FIG. 5, the taper of the outer edge 65 of the prong end 57 slopes outwardly from the front surface 49 to the back surface 51. In some illustrative embodiments, it is also possible to make the taper of the outer edge 65 of the prong end 57 to slope inwardly from the front surface 49 to the back surface 51 and the taper of the inner edge 71 of the receptor end 59 to slope outwardly from the front surface 49 to the back surface 51. In general, the slope direction of the taper of the outer edge 65 should be opposite to the slope direction of the taper of the inner edge 71. The corners 67, 69, 68, 70 (see FIG. 3) may also be tapered along the plate thickness T. In this case, the slope direction of the taper of the corners 67, 69 would be opposite to the slope direction of the taper of the corners 68, 70.

Figure 6:
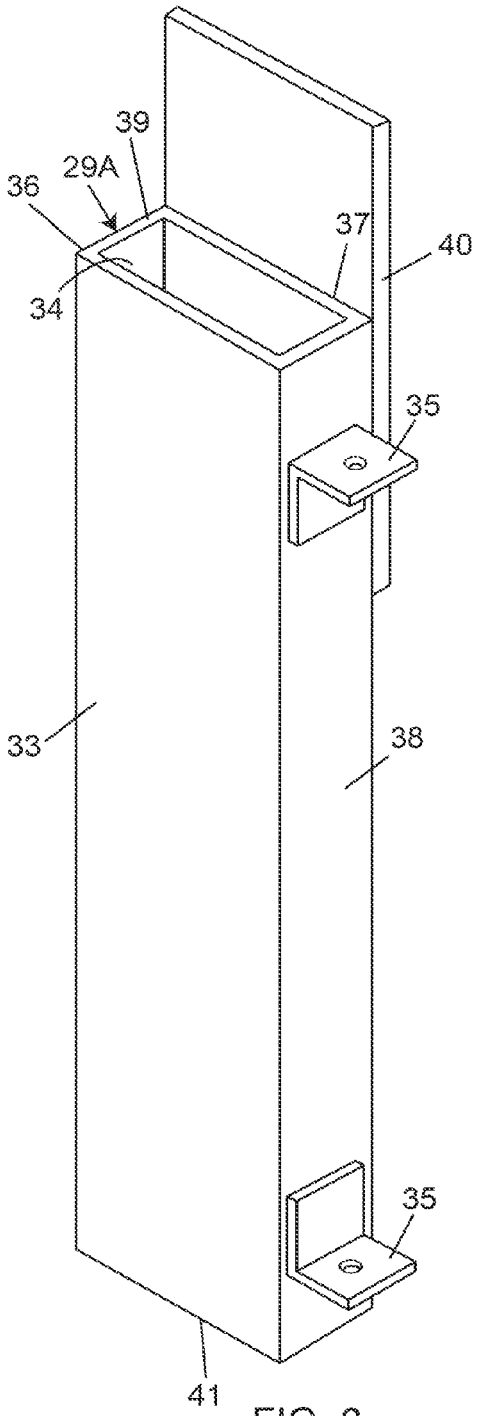
FIG. 6 is a perspective view of a linear beam segment of one illustrative embodiment of the track guiding system disclosed herein.

FIG. 6 shows a perspective view of certain embodiments of the linear beam segment 29A. Depending on the specific application, the linear beam segment 29A may be of any appropriate length, but in some embodiments is at least several feet long. In some embodiments, the linear beam segment 29A may have a tubular or open profile, and in other embodiments may be solid or hollow. The cross-section of the linear beam segment 29A may have any desired shape, e.g., rectangular, square, triangular, U, and W. For example, in the embodiment illustrated in FIG. 6, the linear beam segment 29A has a tubular profile, a rectangular cross-section, and is hollow with an internal cavity 34. Each linear beam segment 29A has a front surface 33 to which a linear plate segment (31A in FIG. 2) may be operatively coupled. In some embodiments, the front surface 33 is planar. Referring to the illustrative embodiment shown in FIG. 2, the width w of the linear beam segment 29A is smaller than the width W of the corresponding linear plate segment 31A, so that the opposite side edges of the linear plate segment 31A overhang the side edges of linear beam segment 29A. This configuration allows the compound edge rollers 25 to roll along the side edges of the linear plate segment 31A without interference from the linear beam segment 29A.

Returning to FIG. 6, the linear beam segment 29A has a back surface 37 in opposing relation to the front surface 33. In certain illustrative embodiments, the back surface 37 is also planar. In the embodiment illustrated in FIG. 6, an alignment plate 40 is operatively coupled to the back surface 37 such that it overhangs the end 39 of linear beam segment 29A. The relevance of the alignment plate 40 will be explained below. The linear beam segment 29A also has opposing side surfaces 36, 38, to at least one of which connection or end tabs 35 may be attached. As shown in FIG. 6, connection tabs 35 may be attached near the opposite ends 39, 41 of the linear beam segment 29A. The relevance of the connection tabs 35 will also be explained below.

Figure 7:
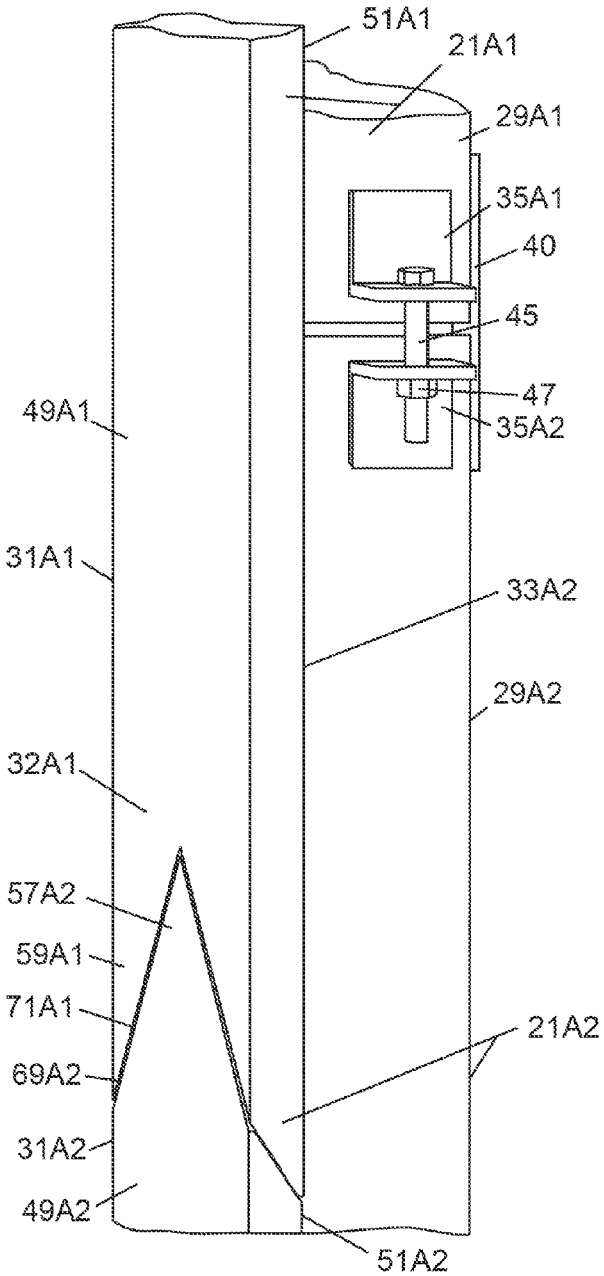
FIG. 7 shows an illustrative connection between two track segments of the track guiding system disclosed herein.

FIG. 7 shows an illustrative connection between two track segments 21A1 and 21A2. The "1" and "2" identifiers appended to 21A are used to identify two of the same track segment. This convention will be adhered to when referring to two objects of the same type, where the details of the objects have already been described above. In the embodiment illustrated in FIG. 7, the track segment 21A1 has a linear plate segment 31A1 operatively coupled to a linear beam segment 29A1, and the track segment 21A2 has a linear plate segment 31A2 operatively coupled to a linear beam segment 29A2. In this mode, the prong end 57A2 of the linear plate segment 31A2 is received in and engaged with the receptor end 59A1 of the linear plate segment 31A1. The inner edge 71A1 of the receptor end 59A1 pushes the outer edge 69A2 of the prong end 57A2 in between the inner edge 71A1 of the receptor end 59A1 and the linear beam segment 29A2 operatively coupled to the linear plate segment 31A2. In general, when a first linear plate segment operatively coupled to a first linear beam segment is connected to a second linear plate segment operatively coupled to a second linear beam segment, the receptor end of the first linear plate segment will push the prong end of the second linear plate segment against the first linear beam segment.

At the joint between the track segments 21A1, 21A2, a portion 32A1 of the linear plate segment 31A1 including the receptor end 59A1 overhangs the linear beam segment 29A1 to which the linear plate segment 31A1 is operatively coupled. This linear plate segment portion 32A1 overlaps and rests on the linear beam segment 29A2 operatively coupled to the linear plate segment 31A2. In addition, in some embodiments the alignment plate 40 operatively coupled to the linear beam segment 29A2 may abut the back surface of the linear beam segment 29A1 so that a socket is formed where the two beams segments 31A1 and 31A2 are coupled together. In certain other illustrative embodiments, after the prong end 57A2 and the receptor end 59A1 are pulled together, the tabs 35A1, 35A2 on the linear beam segments 29A1, 29A2 may be fastened together so as to maintain the connection between the prong end 57A2 and receptor end 59A1 in a firm and stable position. The tabs 35A1, 35A2 may be fastened together using any suitable fastening mechanism known in the art, such as bolts, screws, clamps, couplers and the like. The embodiment illustrated in FIG. 7 shows a bolt 45 inserted into the tabs 35A1, 35A2 and held in place by a nut 47. Other types of fasteners may alternatively be used. In this manner, two or more track segments may be connected as shown in FIG. 7 and described above.

With the arrangement illustrated by the embodiment shown in FIG. 7 and described above, the back surfaces 51A1 and 51A2 of the two linear plate segments 31A1 and 31A2, respectively, are aligned (or flush) due to the back surfaces 51A1, 51A2 of the linear plate segments 31A1, 31A2 overlapping and resting on the same front surface 33A2 of the linear beam segment 29A2. The opposed tapers on the inner edge 71A1 (of the receptor end 59A1) and outer edge 69A2 (of the prong end 57A2) align and secure the linear plate segments 31A1, 31A2 in a plane that is substantially perpendicular to the surfaces 31A1 and 31A2. If P1 is defined as a plane that is substantially perpendicular to the linear plate segment 31A1 and containing the longitudinal axes of the linear plate segment 31A1 and attached linear beam segment 29A, and P2 is defined as a plane that is substantially perpendicular to the linear plate segment 31A2 and containing the longitudinal axes of the linear plate segment 32A2 and attached linear beam segment 29A, then P1 and P2 are substantially coplanar when the track segments 21A1 and 21A2 are aligned as shown in FIG. 7. The front surfaces 49A1, 49A2 of the two adjacent linear plate segments 31A1, 31A2 may or may not be aligned (or flush). As will be described below, the compound edge rollers (25 in FIG. 2) that will ride on these surfaces may be elastic-supported, which in some embodiments may enable the compound edge rollers 25 to compensate for any discontinuity at the interface between the front surfaces 49A1, 49A2 of the adjacent linear plate segments 31A1, 31A2.

Figure 8:
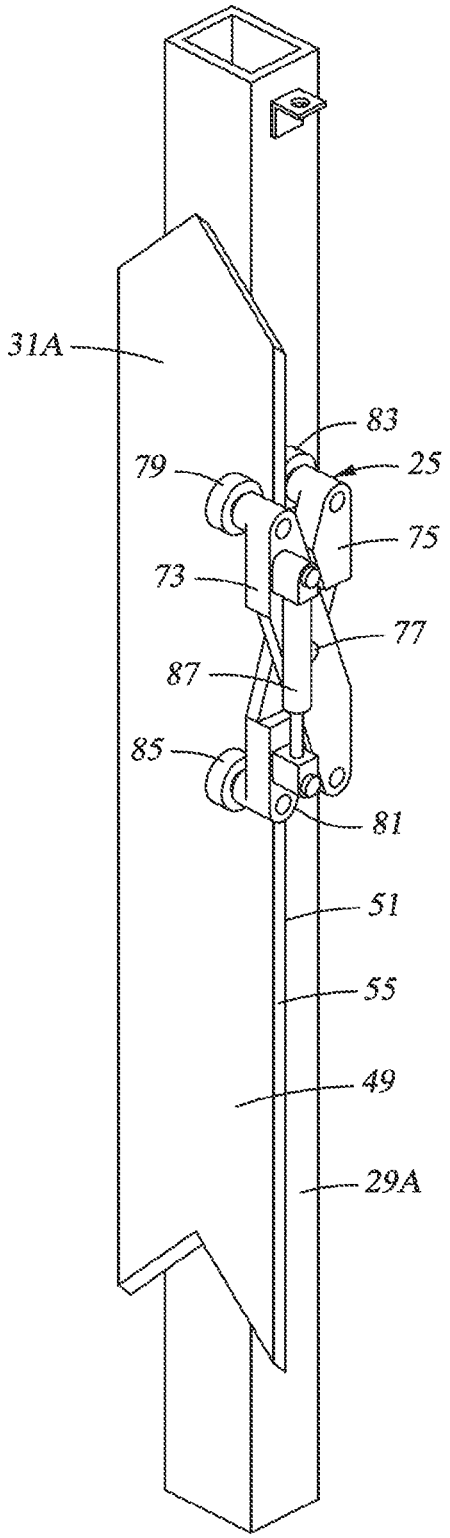
FIG. 8 shows an illustrative embodiment of a first compound edge roller at an edge of a linear plate segment operatively coupled to a linear beam segment of the track guiding system disclosed herein.

FIG. 8 shows certain illustrative embodiments of the present subject matter, including a compound edge roller 25 (one of the two pairs previously shown in FIG. 2) at the edge 55 of a linear plate segment 31A. In the illustrative embodiment shown, the linear plate segment 31A is operatively coupled to a linear beam segment 29A. For clarity, other components of the track guiding system are omitted from FIG. 8 to allow focus on the features of the compound edge roller 25. As shown in FIG. 8, the compound edge roller 25 includes arms 73, 75 coupled together and rotatable about the joint 77. The joint 77 may be any suitable rotatable joint formed in any suitable manner known in the art. For example, in some illustrative embodiments the joint 77 may be formed by providing holes in each of the arms 73, 75 coincident with the location of the joint 77, inserting a bolt through the coincident holes and securing the bolt in place. In other illustrative embodiments, a pin is formed on one of the arms 73, 75 and a hole is formed on the other of the arms 73, 75 coincident with the location of the joint 77. In such embodiments, the pin is inserted in the hole and secured with a lock member, such as a nut, to prevent the pin from being dislodged from the hole. In yet other embodiments, the pin may be self-locking, i.e., it may include a snap feature for securing the other arm in place. As illustrated in FIG. 2, the carriage 23 may also, in some illustrative embodiments, be coupled to the compound edge roller 25 at the rotatable joint 77 of the compound edge roller 25.

Returning to FIG. 8, in some embodiments the arm 73 may carry two roller elements (or rollers) 79, 81 and the arm 75 may also carry two roller elements (or rollers) 83, 85. In certain illustrative embodiments, the roller elements 79, 85 may be adjacent to the front surface 49 of the linear plate segment 31A, and the roller elements 83, 81 may be adjacent to the back surface (51 in FIG. 7) of the linear plate segment 31A. In the illustrative embodiment shown in FIG. 8, roller elements 79, 81 and 83, 85 are supported on the arms 73, 75, respectively, so that they can rotate relative to the arms 73, 75, respectively. For example, spools (or studs) may be formed on the supports arms 73, 75, and the roller elements may be cylindrical rollers having a hole in center thereof for mounting on the spools. The spools may be self-locking, or a lock member, such as a nut, collar, ferrule and the like, may be used to secure the roller elements such that the roller elements do not slip off the arms during use. In one illustrative embodiment, a roller element may be made of a rigid cylindrical element. Alternatively, in certain other illustrative embodiments a roller element may be made of two rigid cylindrical elements with an elastomer sandwiched between the cylindrical elements.

In other illustrative embodiments, the compound edge roller may have only three roller elements in lieu of the four roller elements 79, 81 and 83, 85 as illustrated in FIG. 8. That is, one of the roller elements, e.g., roller 81, may be eliminated, such that the compound edge roller has two arms and carries three roller elements in total on the two arms 73, 75. In some illustrative embodiments, a first of the three roller elements may be adjacent to the front surface of the linear plate segment, a second of the three roller elements may be adjacent to the back surface of the linear plate segment, and a third of the three roller elements may be adjacent to the front surface of the linear plate segment. In yet another illustrative embodiment, the first and second of the three roller may be located adjacent to the front and back surfaces, respectively, of the linear plate segment as noted above, whereas the third of the three rollers may be adjacent to back surface of the linear plate segment.

In certain illustrative embodiments of the present subject matter, a tensioning member 87 may be coupled to the arms 73, 75. (To simplify the drawings, the tensioning member 87 is not visible in FIG. 2.) In general, the rotational axis of each roller element is perpendicular to the longitudinal axis (i.e., the length) of the arm on which it is rotatably supported. As shown in FIG. 8, the tensioning member 87, as-coupled, is between the arms 73, 75 and serves to apply a force that biases the arms 73, 75 away from each other in one direction and towards each other in another direction. That is, the tensioning member 87 may be actuated to move the arms in much the same way that a pair of scissors operates when being opened or closed. The tensioning member 87 thereby applies the force such that contact is maintained between the roller elements 79, 81 and 83, 85 and the front and back surfaces 49, 51 of the linear plate segment 31A, respectively, as the compound edge roller 25 rolls along the edge 55 thereof. The tensioning member 87 may be any mechanism capable of applying force to the arms 73, 75 in the manner described above. For example, in some illustrative embodiments the tensioning member 87 may be a fluid-powered cylinder, e.g., a hydraulic cylinder or a pneumatic cylinder. Alternatively, in certain other embodiments the tensioning member 87 may be a type of spring element, such as a tension spring, compression spring, torsion spring or clip spring. In those embodiments utilizing a fluid-powered cylinder, the cylinder may be coupled to one of the arms 73, 75, and the piston or ram (which is axially movable relative to the cylinder) may be coupled to the other of the arms 73, 75. The tensioning member 87 may in some embodiments be pre-configured to apply a certain amount of force to the arms 73, 75 to maintain contact between the roller elements and the surfaces of the linear plate segment 31A as previously described. The tensioning member 87 thereby allows the compound edge roller 25 to be "elastic," which in the present instance means that the compound edge roller 25 is capable of dynamically adapting to the profile of the surface along which it travels.

Figure 9:
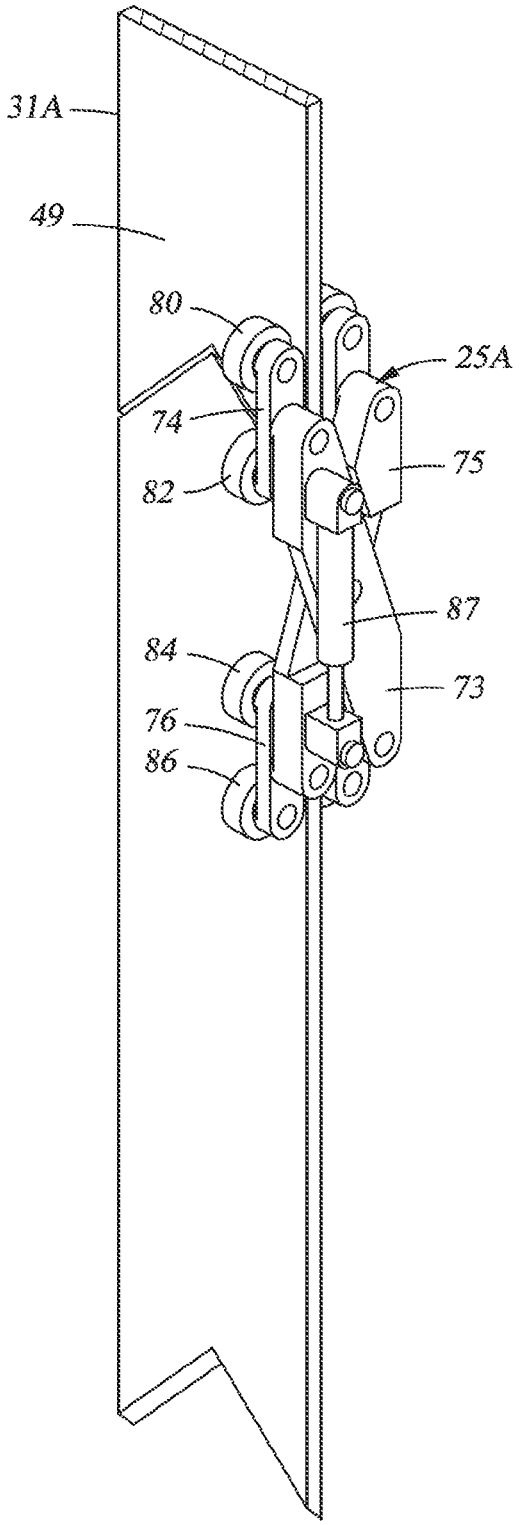
FIG. 9 shows an illustrative embodiment of a second compound edge roller at an edge of a linear plate segment of the track guiding system disclosed herein.

FIG. 9 shows another illustrative embodiment of a compound edge roller. The compound edge roller 25A shown in FIG. 9 may be similar to the compound edge roller 25 of FIG. 8 in many aspects, however compound edge roller 25A additionally comprises plates 74, 76 operatively coupled to one end of each of the arms 73, 75, respectively. In the embodiment illustrated in FIG. 9, plates 74, 76 are operatively coupled to the ends of arms 73, 75 adjacent to the front surface 49 of the linear plate segment 31A. Plate 74 carries two roller elements 80, 82, while plate 76 carries two roller elements 84, 86. In some embodiments, tensioning member 87 may also help maintain contact between the rollers on the arms 73, 75 and plates 74, 76 and the surfaces of the linear plate segment 31A as the compound edge roller 25A travels along the edge of the linear plate segment 31A. As will be appreciated by those skilled in the art and having the benefit of the present disclosure, compound edge roller 25A may be used in place of compound edge roller 25 shown in FIG. 2.

Figure 10:
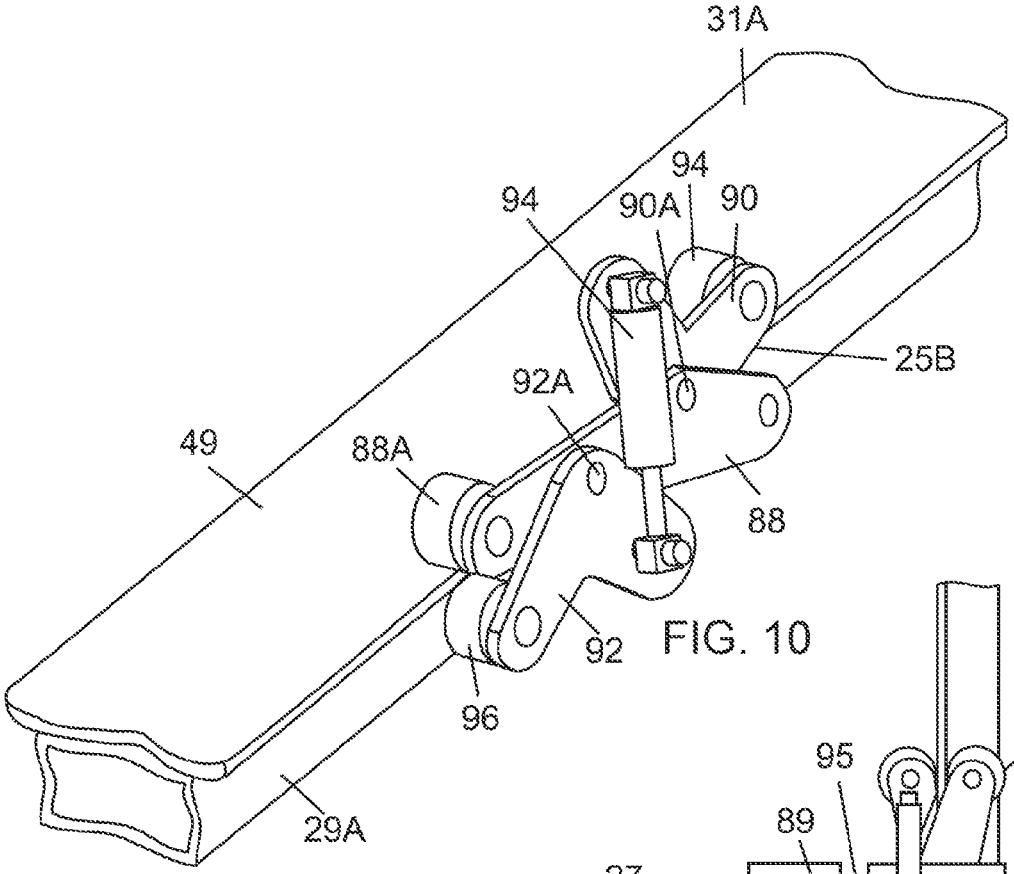
FIG. 10 shows an illustrative embodiment of a third compound edge roller at an edge of a linear plate segment of the track guiding system disclosed herein.

FIG. 10 shows yet another illustrative embodiment of a compound edge roller 25B, comprising a main arm 88 and two auxiliary arms 90, 92. In some embodiments, main arm 88 is generally linear or elongated in shape and carries roller elements 88A on opposing ends (only one roller element 88A is visible in FIG. 10). Auxiliary arm 90 has an angular or triangular shape and comprises a roller element 94 operatively coupled to one end thereof. In certain embodiments, the middle of auxiliary arm 90 is operatively coupled to main arm 88 at joint 90A such that auxiliary arm 90 is independently rotatable relative to main arm 88. Similarly, auxiliary arm 92 has an angular or triangular shape and comprises a roller element 96 operatively coupled to one end thereof. The middle of auxiliary arm 92 is similarly coupled to main arm 88 at joint 92A such that auxiliary arm 92 is also independently rotatable relative to main arm 88. In one illustrative embodiment, a tensioning member 94 is also operatively coupled to diametrically-opposed ends of the auxiliary arms 90, 92 (i.e., the ends of the auxiliary arms not coupled to roller elements 94, 96 or to main arm 88). The tensioning member 94 is as described above for the compound edge roller 25 (87 in FIG. 8) and operates to maintain contact between the roller elements 88A, 94, 96 carried by the main and auxiliary arms 88, 90, 92, respectively and the front and back surfaces of the linear plate segment 31A. As will be appreciated by those skilled in the art and having the benefit of the present disclosure, compound edge roller 25B may also be used in place of the compound edge roller 25 in FIG. 2.

Figure 11:
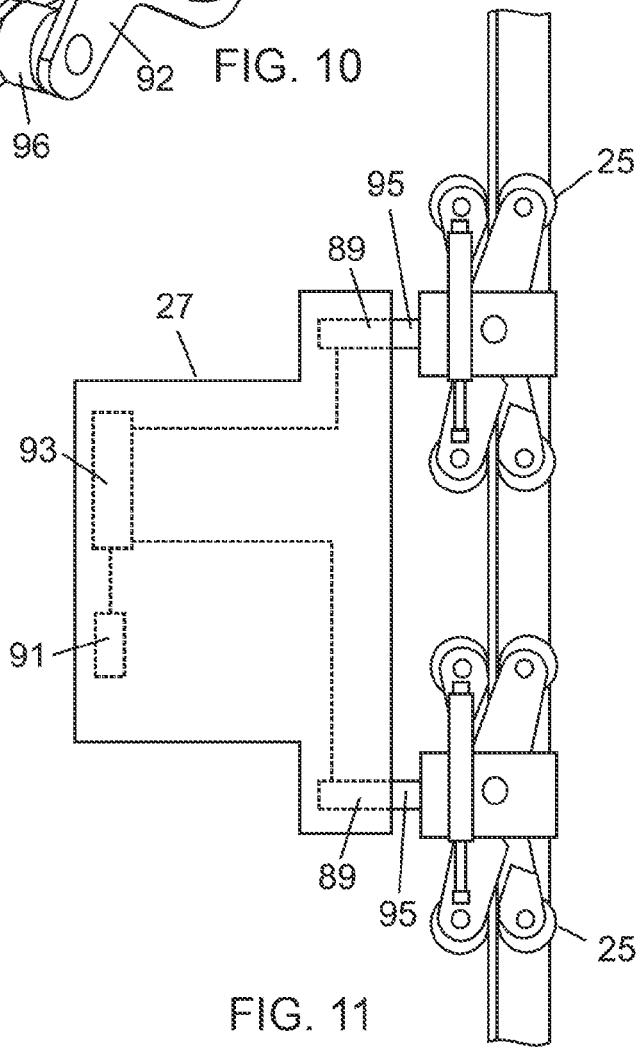
FIG. 11 shows an elevation view of a top drive coupled to one illustrative embodiment of the track guiding system disclosed herein.

FIG. 11 shows one illustrative embodiment of an interface between the top drive 27 and the carriage 23. As shown in FIG. 11, one or more movable joints 95 may be formed between the top drive 27 and the carriage 23. In some embodiments, movable joints 95 may be adjusted to tilt the top drive 27 relative to the vertical, e.g., in order to adjust the verticality of the top drive 27. In certain embodiments, the movable joints 95 are extensible joints that may be extended or shortened to tilt the top drive 27 relative to the vertical. In certain other embodiments, the extensible joints may be provided by actuators 89 operatively coupled to both the top drive 27 and the carriage 23. In one illustrative embodiment, the actuators 89 may be linear actuators, which may in certain specific embodiments be fluid-powered cylinders, e.g., hydraulic or pneumatic cylinders. In further embodiments of the present subject matter, at least three spaced-apart extensible joints 95 may be provided to allow tilting adjustment of the top drive in three-dimensions, each of which may include an actuator 89. Additional extensible joints 95 may be provided as desired, or as may be required by the specific application. (Note: Only two actuators 89 are visible in the elevation view of FIG. 11.) In certain other embodiments, movable joint 95 may be a rotary joint, e.g., joystick or ball-and-socket joint. In some such embodiments, one rotary actuator may be sufficient to tiltably adjust the top drive 27 relative to the vertical.

In some illustrative embodiments of the present subject matter, one or more sensors 91 may be provided to measure the verticality of the top drive 27. In one embodiment, verticality measurements may be continuously performed, whereas in other illustrative embodiments, verticality measurements may only be performed periodically, or on demand by an operator. For illustrative purposes only, a sensor 91 is shown in FIG. 11 inside the housing of the top drive 27, but may in other embodiments be mounted outside the housing of the top drive 27. The sensor 91 measures the verticality of the top drive 27, which measurements are used to perform adjustments of the movable joint(s) 95. In addition to the sensor 91, the verticality adjustment system may include a processing unit 93 programmed or adapted to determine how to adjust the movable joint(s) 95. For example, if the movable joints 95 are extensible joints, the processing unit 93 may be adapted to determine how far to extend or shorten each of the extensible joints to achieve a desired tilt of the top drive 27. In some embodiments, the processor 93 may receive data from the sensor 91, process the data in order to determine the angular deviation of the top drive 27 from the vertical, and, as necessary, send signals to the movable joints 95 (e.g., the actuators 89) to tiltably adjust the top drive 27 so that the top drive 27 is substantially aligned with the vertical. The processor 93 may in some embodiments be disposed within the housing of the top drive 27, or may in other embodiments be provided in a separate housing with a suitable communication path between the processor 93 and the sensor 91 and movable joints 95.

Figure 12:
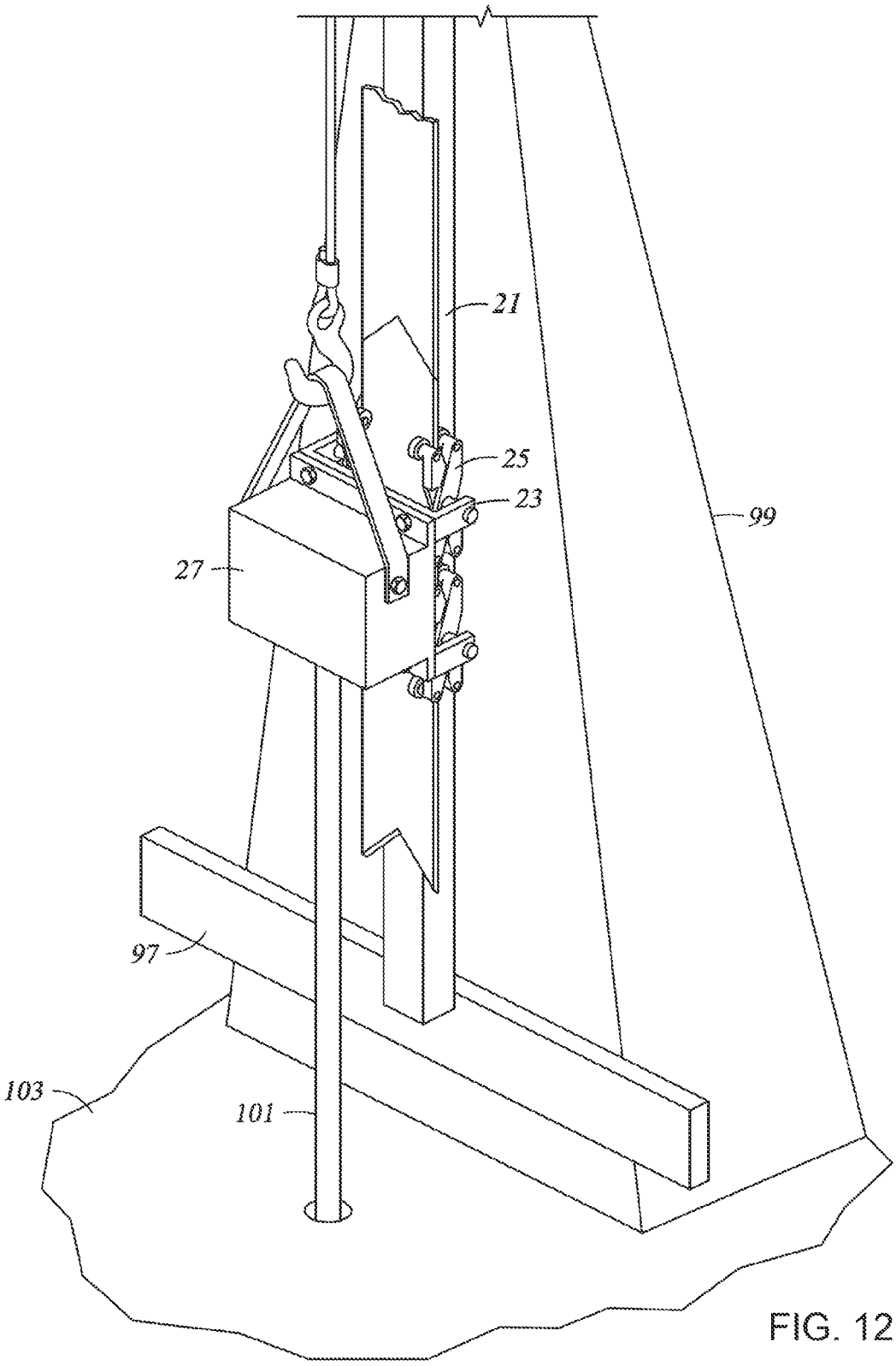
FIG. 12 is a perspective view of one illustrative embodiment of the track guiding system disclosed herein in a drilling environment.

FIG. 12 shows one embodiment of the track 21 in an exemplary environment of use. As shown in FIG. 12, the bottom of the track 21 may be operatively coupled to a plate 97, which may in turn be anchored to a derrick 99. Although not shown, the top of the track 21 may also be secured to the derrick 99. In some embodiments, lateral braces (also not shown) may also be used to secure the track 21 to the derrick at spaced-apart locations along the track 21. The carriage 23 may be supported for travel along the track 21 on the compound edge rollers 25. A top drive 27 may also be coupled to the carriage 23. The length of the track 21 may, in certain embodiments, be selected to match the desired travel length of the top drive 27 along a vertical path provided by the track 21. The top end of a drill string 101 may also be coupled to the top drive 27, while the bottom end of the drill string 101 may extend through the rig floor 103 into a borehole beneath the rig floor 103. With the arrangement illustrated by this embodiment, the top drive 27 may be used to rotate the drill string 101 while also traveling along the track 21 as required by the specific drilling operation.

As described above, the compound edge rollers 25 may be adapted to maintain contact with the track 21 as the top drive 27 travels along the track 21. Furthermore, alignment of the top drive 27 may be maintained in a substantially vertical direction by actively measuring the verticality of the top drive 27 and adjusting the verticality to the top drive 27 as required. In the instant case, the term "verticality" means the angular position of the top drive 27 relative to true vertical. Consequently, if the top drive 27 is precisely aligned with true vertical, then verticality will be zero. Conversely, if the top drive 27 is not precidely aligned with true vertical, then verticality will not be zero. In some illustrative embodiments disclosed herein, the tilt of the top drive 27 relative to the vertical may be adjusted until verticality is substantially zero, or in other words, until the top drive 27 is substantially aligned with the true vertical direction. Moreover, when the top drive 27 is substantially aligned with the true vertical direction, this typically means that the centerline or axis of the top drive 27 is substantially aligned with the true vertical direction.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A track guiding system, comprising:

a first track segment having a first end and a second end, said first track segment comprising a first linear beam segment operatively coupled to a first linear plate segment, wherein said first linear beam segment has first and second beam ends and said first linear plate segment has first and second plate ends, said first beam end and said first plate end being proximate said first end of said first track segment and said second beam end and said second plate end being proximate said second end of said first track segment; and a second track segment having a first end and a second end, said second track segment comprising a second linear beam segment operatively coupled to a second linear plate segment, wherein said second linear beam segment has third and fourth beam ends and said second linear plate segment has third and fourth plate ends, said third beam end and said third plate end being proximate said first end of said second track segment and said fourth beam end and said fourth plate end being proximate said second end of said second track segment, wherein said first end of said first track segment is adapted to be operatively coupled to said second end of said second track segment, and wherein a face of said first beam end of said first linear beam segment proximate said first end of said first track segment is adapted to overlap and contactingly engage a face of said fourth plate end of said second linear plate segment proximate said second end of said second track segment when said second end of said second track segment is operatively coupled to said first end of said first track segment.

2. The track guiding system of claim 1, wherein said first beam end of said first linear beam segment overhangs and extends beyond said first plate end of said first linear plate segment along a first length direction of said first track segment, said second plate end of said first linear plate segment overhangs and extends beyond said second beam end of said first linear beam segment along said first length direction, said third beam end of said second linear beam segment overhangs and extends beyond said third plate end of said second linear plate segment along a second length direction of said second track segment, and said fourth plate end of said second linear plate segment overhangs and extends beyond said fourth beam end of said second linear beam segment along said second length direction.

3. The track guiding system of claim 2, wherein a length of said first linear beam segment is approximately the same as a length of said first linear plate segment, and a length of said second linear beam segment is approximately the same as a length of said second linear plate segment.

4. The track guiding system of claim 1, wherein said first plate end of said first linear plate segment has a generally V-shaped prong configuration and said fourth plate end of said second linear plate segment has a generally V-shaped receptor configuration, said generally V-shaped prong end of said first linear plate segment being adapted to contactingly engage said generally V-shaped receptor end of said second linear plate segment when said first end of said first track segment is operatively coupled to said second end of said second track segment.

5. The track guiding system of claim 4, wherein said generally V-shaped prong end of said first linear plate segment and said generally V-shaped receptor end of said second linear plate segment are adapted to substantially align first and second opposing side edges of said first linear plate segment with respective first and second opposing side edges of said second linear plate segment when said generally V-shaped prong end contactingly engages said generally V-shaped receptor end.

6. The track guiding system of claim 1, wherein each of said first and second track segments has a length direction running from said first end to said second end and a lateral direction that is perpendicular to said length direction, and wherein said first and second linear beam segments are operatively coupled to said respective first and second linear plate segments such that first and second opposing side edges of each of said first and second linear plate segments overhang and extend beyond corresponding opposing side surfaces of said respective first and second linear beam segments in said lateral direction.

7. The track guiding system of claim 1, wherein said first plate end of said first linear plate segment has a first tapered edge that is tapered through a plate thickness of said first linear plate segment at a first angle relative to a front face of said first linear plate segment and said fourth plate end of said second linear plate segment has a second tapered edge that is tapered through a plate thickness of said second linear plate segment at a second angle relative to a front face of said second linear plate segment, said first tapered edge of said first linear plate segment being adapted to contactingly engage said second tapered edge of said second linear plate segment when said first end of said first track segment is operatively coupled to said second end of said second track segment, said second angle of said second tapered edge being a supplementary angle to said first angle of said first tapered edge.

8. The track guiding system of claim 7, wherein said first and second tapered edges of said respective first and second linear plate segments are adapted to substantially align front and back surfaces of said first linear plate segment with respective front and back surfaces of said second linear plate segment when said first tapered edge contactingly engages said second tapered edge.

9. The track guiding system of claim 7, wherein said face of said first beam end of said first linear beam segment is a front surface of said first linear beam segment and said face of said fourth plate end of said second linear plate segment is a back surface of said second linear plate segment, said front surface of said first linear beam segment being adapted to be pushed into said contacting engagement with said back surface of said second linear plate segment when said first tapered edge of said first linear plate segment contactingly engages said second tapered edge of said second linear plate segment.

10. The track guiding system of claim 1, further comprising end tabs attached to said first beam end of said first linear beam segment and to said fourth beam end of said second linear beam segment, wherein said end tabs are adapted to operatively couple said first linear track segment to said second track segment so as to bring said fourth plate end of said second linear plate segment into contacting engagement with said first plate end of said first linear plate segment.

11. The track guiding system of claim 1, wherein each of said first and second track segments further comprises an alignment plate that is operatively coupled to one end of a respective linear beam segment and on an opposite side of said linear beam segment from a respective linear plate segment, said alignment plate overhanging and extending beyond said end of said respective linear beam segment to which said alignment plate is operatively coupled.

12. The track guiding system of claim 1, further comprising a third track segment comprising a third linear beam segment operatively coupled to a third linear plate segment and having a first end and a second end, wherein said third linear beam segment has fifth and sixth beam ends and said third linear plate segment has fifth and sixth plate ends, said fifth beam end and said fifth plate end being proximate said first end of said third track segment and said sixth beam end and said sixth plate end being proximate said second end of said third track segment, wherein said first end of said third track segment is adapted to be operatively coupled to said second end of said first track segment, and wherein said fifth beam end of said third linear beam segment overhangs and extends beyond said fifth plate end of said third linear plate segment along a length direction of said third track segment and said sixth end of said third linear beam segment overhangs and extends beyond said sixth plate end of said third linear plate segment along said length direction of said third track segment.

13. The track guiding system of claim 1, further comprising a rolling carriage that is adapted to rollingly engage at least one of each of said first and second linear plate segments of said respective first and second track segments.

14. The track guiding system of claim 13, further comprising a top drive operatively coupled to said rolling carriage.

15. The track guiding system of claim 1, wherein each of said first and second linear plate segments is a flat plate having a front plate surface and a back plate surface, said first and second linear beam segments being operatively coupled to said back plate surface of a corresponding one of said first and second linear plate segments.

16. The track guiding system of claim 1, wherein said first linear beam segment has a first lateral beam width and said first linear plate segment has a first lateral plate width that is greater than said first lateral beam width, and wherein said second linear beam segment has a second lateral beam width and said second linear plate segment has a second lateral plate width that is greater than said second lateral beam width.

17. The track guiding system of claim 16, wherein said first lateral beam width is substantially the same as said second lateral beam width and said first lateral plate width is substantially the same as said second lateral plate width.

18. The track guiding system of claim 1, wherein length directions of each of said first and second track segments are adapted to be substantially vertically aligned when said second end of said second track segment is operatively coupled to said first end of said first track segment, and wherein said face of said first beam end of said first linear beam segment and said face of said fourth plate end of said second linear plate segment are each adapted to be substantially vertically oriented when brought into said overlapping contacting engagement.

19. A track guiding system comprising a plurality of track segments each having first and second track segment ends, wherein a first track segment end of each one of said plurality of track segments is adapted to be operatively coupled to a second track segment end of another one of said plurality of track segments, each of said plurality of track segments comprising:

a linear plate segment having a first plate end that is proximate said first track segment end and a second plate end that defines said second track segment end, said first plate end having a first generally V-shaped connection and said second plate end having a second generally V-shaped connection, wherein a first V-shaped connection of a linear plate segment of a first track segment of said plurality of track segments is adapted to contactingly engage a corresponding second V-shaped connection of an adjacent linear plate segment of a second track segment of said plurality of track segments when a first track segment end of said first track segment is operatively coupled to a second track segment end of said second track segment; and a linear beam segment operatively coupled to said linear plate segment and having a first beam end that defines said first track segment end and a second beam end that is proximate said second track segment end, said first beam end overhanging and extending beyond said first plate end along a length direction of said track segment and said second plate end overhanging and extending beyond said second beam end along said length direction, wherein a back surface of a second plate end of said linear plate segment of said first track segment is adapted to overlap and contactingly engage a front surface of a first beam end of said linear beam segment of said second track segment when said first track segment end of said first track segment is operatively coupled to said second track segment end of said second track segment.

20. The track guiding system of claim 19, wherein a length of said linear beam segment is approximately the same as a length of said linear plate segment.

21. The track guiding system of claim 19, wherein said first generally V-shaped connection and said second generally V-shaped connection are adapted to substantially align first and second opposing side edges of said adjacent linear plate segments when said first track segment end of said first track segment is operatively coupled to said second track segment end of said second track segment.

22. The track guiding system of claim 19, wherein an edge of said first generally V-shaped connection has a first taper through a thickness of said linear plate segment and an edge of said second generally V-shaped connection has a second taper through said thickness of said linear plate segment, said first tapered edge being adapted to contactingly engage said second tapered edge when said first track segment end of said first track segment is operatively coupled to said second track segment end of said second track segment.

23. The track guiding system of claim 22, wherein said first and second tapered edges are adapted to substantially align front and back surfaces of adjacent linear plate segments when said first track segment end of said first track segment is operatively coupled to said second track segment end of said second track segment.

24. The track guiding system of claim 22, wherein said first and second tapered edges are adapted to bring said back surface of said second plate end of said linear plate segment of said first track segment into said contacting engagement with said front surface of said first beam end of said linear beam segment of said second track segment when said first track segment end of said first track segment is operatively coupled to said second track segment end of said second track segment.

25. The track guiding system of claim 19, wherein said first generally V-shaped connection is a generally V-shaped prong connection and wherein said second generally V-shaped connection is a generally V-shaped receptor connection.

26. The track guiding system of claim 19, wherein a plate width of said linear plate segment in a lateral direction of said track segment that is perpendicular to said length direction is greater than a beam width of said linear beam segment in said lateral direction, and wherein a back surface of said linear beam segment is operatively coupled to a front surface of said linear plate segment such that each opposing side edge of said linear plate segment overhangs and extends beyond a corresponding opposing side surface of said linear beam segment in said lateral direction.

27. The track guiding system of claim 19, wherein said linear plate segment is a flat plate having a front plate surface and a back plate surface, said linear beam segment being operatively coupled to said back plate surface.

28. The track guiding system of claim 27, wherein said linear beam segment has a front beam surface and a back beam surface in opposing relationship to said front beam surface, said front beam surface being directly attached to said back plate surface, each of said plurality of track segments further comprising an alignment plate that is attached to said back beam surface of said linear beam segment opposite of said linear plate segment.

* * * * *